United States Patent [19]

Mock

[11] 4,341,255

[45] Jul. 27, 1982

[54] STORM WINDOW

[75] Inventor: Donald E. Mock, Azusa, Calif.

[73] Assignee: Cetec Corporation, El Monte, Calif.

[21] Appl. No.: 273,225

[22] Filed: Jun. 12, 1981

[51] Int. Cl.[3] ..... A47H 3/00; E06B 3/00

[52] U.S. Cl. ..... 160/369; 160/368 R; 160/392; 160/395; 24/243 K

[58] Field of Search ..... 160/354, 368 R, 369, 160/371, 380, 392, 395; 24/243 K

[56] References Cited

U.S. PATENT DOCUMENTS

| | | | |
|---|---|---|---|
| 2,736,521 | 2/1956 | Bosserman | 160/392 |
| 2,783,834 | 3/1957 | Brame | 160/395 |
| 3,127,926 | 4/1964 | Adelt | 160/371 |
| 3,464,480 | 9/1969 | Kuss | 160/368 R |
| 4,107,826 | 8/1978 | Tysdal | 160/395 |
| 4,133,367 | 1/1979 | Abell | 160/392 |
| 4,158,244 | 6/1979 | Stefan | 24/243 K |

FOREIGN PATENT DOCUMENTS

| | | | |
|---|---|---|---|
| 1245940 | 10/1960 | France | 160/395 |

*Primary Examiner*—Peter M. Caun

[57] ABSTRACT

A storm window or the like formed of plastic extrusions with a frame, glazing sheet, and lock strips pushed into grooves of the frame, holding the glazing sheet between the frame members and lock strips. A removable frame formed of frame members joined together at the corners by corner fasteners with arms which push into slots of the frame members. Mounting clips for mounting the window to a support surface, with variations for flush mounting and recess mounting, with the mounting clips snapping into grooves in the lock strip.

14 Claims, 7 Drawing Figures

STORM WINDOW

BACKGROUND OF THE INVENTION

This invention relates to storm windows, screen doors, and the like, and in particular to a new and improved window construction suitable for production with extruded parts, typically plastic extrusions, and a glazing or screening, such as a flexible plastic sheet or screen or a rigid plastic or glass sheet. One embodiment of the invention will be described herein as a window with a flexible glazing sheet, but it will be understood that the invention is equally applicable to doors and the like and to flexible screening sheets and the like. Another embodiment to be described will utilize glass or a rigid plastic such as acrylic as the glazing.

Storm windows with soft or flexible glazing and with interlocking frame members and lock strips have been proposed in the past. However these windows have been difficult to install, requiring placement of individual frame members about the window, after which the glazing and lock strips are installed.

It is an object of the invention to provide a new and improved window and in particular, one which can be installed and removed with ease and at reduced cost by reducing the cost of components, the assembly time and effort, and the installation time and effort. A further object is to provide a window design which may be fully assembled and stored ready for use, and a window which is easily installed by means of pop-in mounting clips.

Other objects, advantages, features and results will more fully appear in the course of the following description.

SUMMARY OF THE INVENTION

A window having a frame with frame members defining a glazing face, with grooves in opposing frame members at the glazing face, a glazing sheet over the frame members, and lock strips inserted in opposing grooves, with the glazing sheet disposed between the lock strips and frame members. An interlocking engagement between the lock strips and frame members for holding the components together. Mounting clips, positioned in grooves in the lock strips for attaching the window to a support surface, preferably with interlocking engagement between the mounting clips and the lock strip. A removable frame formed of elongate frame members joined by corner fasteners, with the fasteners having arms sliding in grooves in the frame members and preferably having the fasteners and/or slots configured to provide an interference fit. A removable window with flexible or rigid glazing.

DESCRIPTION OF THE PREFERRED EMBODIMENT

Figure 1:
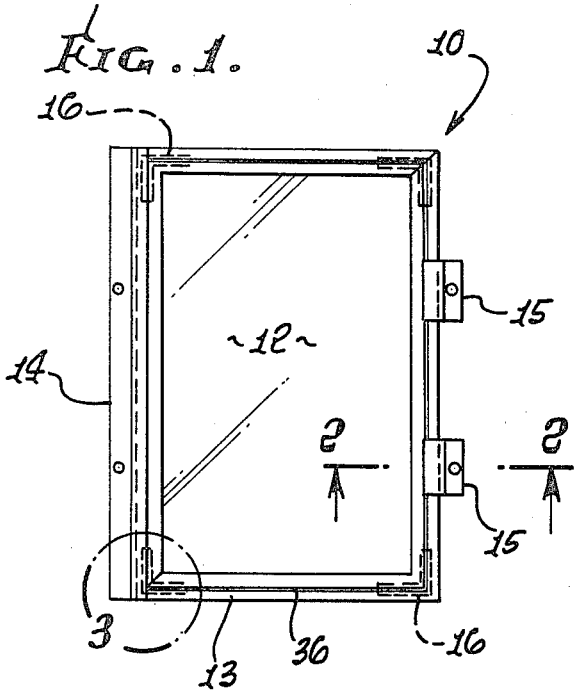
FIG. 1 is a front view of a window incorporating the presently preferred embodiment of the invention.
Figure 2:
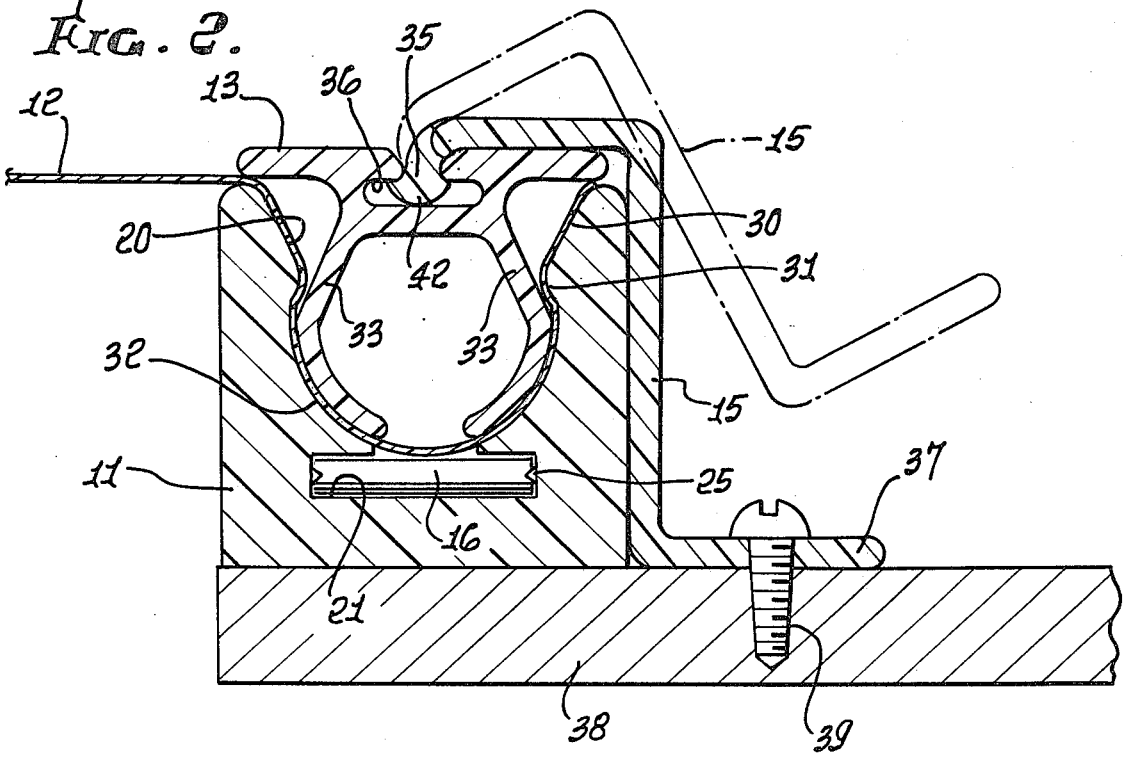
FIG. 2 is an enlarged partial sectional view taken along the line 2—2 of FIG. 1.

The window in FIGS. 1 and 2 includes a frame 10 formed of frame members 11, a flexible glazing sheet 12, lock strips or splines 13, mounting clips 14, 15, and corner fasteners 16.

Figure 4:
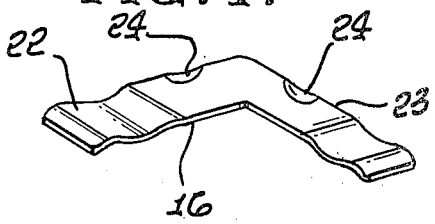
FIG. 4 is an enlarged perspective view of a corner fastener of the window of FIG. 1.
Figure 3:
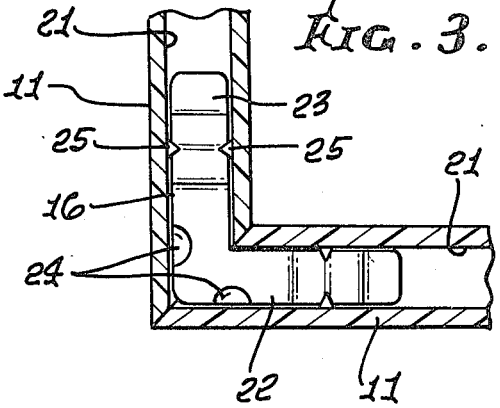
FIG. 3 is an enlarged partial sectional view of the area indicated by the dashed circle 3 of FIG. 1.

The frame members 11 preferably are extrusions, typically plastic extrusions, with a groove 20 and a slot 21. The corner fastener 16 has arms 22, 23 disposed at right angles to each other, and typically is a metal stamping, preferably with curved or corrugated ends, as best seen in FIG. 4. Also dimples 24 preferably are fomred in the fastener near the intersection of the arms.

The frame 10 is formed of four of the frame members 11, with the ends cut at 45 degrees, and with a corner fastener 16 at each corner of the frame, with the arms 22, 23 inserted in the slots 21 of the corresponding frame members. The arms of the corner fasteners and the slots of the frame members preferably are sized so that there is an interference fit, both for joining the frame members together and for providing alignment. This may be achieved by utilizing the curved ends of the corner fasteners and the dimples near the intersection of the two arms. Alternatively it may be achieved by providing one or more protrusions or serrations 25 in the frame member 11 projecting into the slot.

The lock strips 13 are designed to be push fits into the grooves 20 of the frame members 11, preferably with an interlocking type engagement. In the preferred embodiment illustrated, the groove 20 in the frame member 11 has an outwardly flaring mouth 30, a narrower throat section 31, and a wider base section 32. The lock strip 13 preferably has spaced fingers 33 which have an overall width greater than the width of the throat section 31. The fingers are flexible so that the lock strip can be pushed into the groove of the frame members, as best seen in FIG. 2. The lock strips preferably are extrusions, typically plastic extrusions.

In assembling the window, the four frame members are joined together as previously described. Then the glazing sheet 12 is laid over the frame and the lock strips are pushed into place, locking the glazing between the lock strips and frame members and stretching the glazing. This could be accomplished with two opposing lock strips, but it is preferred to utilize four of the lock strips with mitered corners, as shown in FIG. 1.

A single long mounting clip 14 is shown on the left side of the window of FIG. 1, and two short mounting clips 15 are shown on the right side. These clips 14 and 15 have the same shape, and of course, any number and size of mounting clips may be utilized as desired. Making the clips 14 the full length of the frame, as shown in FIG. 1, helps to prevent bugs and the like entering between the window and the structure to which it is mounted. The clip 15, as best seen in FIG. 2, has an inner end 35 for entering a groove 36 in the lock strip, and an outer end 37 for attachment to a support surface 38 or the like, typically by screws 39.

In the embodiment illustrated, the groove 36 of the lock strip 13 has a narrower throat section and a wider base section for interlocking engagement with the enlarged inner end of the clip 15. Preferably the clip has a rounded tip 42 of greater width than the adjacent portion of the clip, permitting a rocking insertion of the clip into the groove, as illustrated in FIG. 2. The initial position of the clip for inserting the tip past the narrow throat section is shown in dashed lines, while the final position for the clip is shown in solid lines. The clip may be fabricated in various conventional manners, but preferably also is a plastic extrusion.

Figure 5:
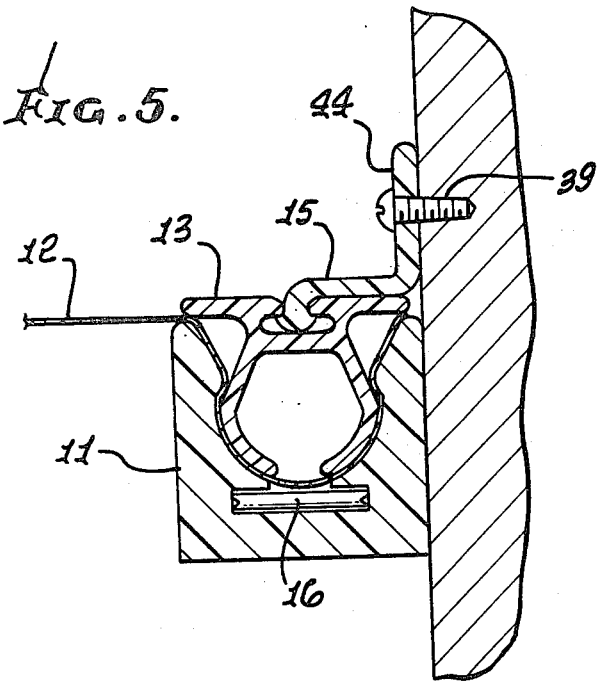
FIGS. 5 and 6 are views similar to that of FIG. 2 showing alternative mounting configurations.
Figure 6:
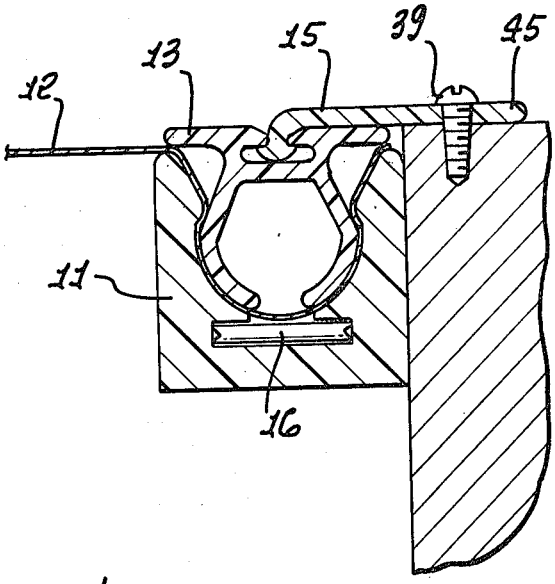

The outer end of the clip 15 may take various shapes, depending upon the type of mounting desired. A clip 15 with outer end 44 for recess mounting of the frame is shown in FIG. 5. A clip 15 with outer end 45 for flush mounting of the frame is shown in FIG. 6. While the frame 10 is shown composed of four frame members joined by corner fasteners, it will be understood that other frame configurations can be utilized. Also, the corner fasteners can be dispensed with, with the stretched glazing sheet serving to hold the frame members together.

Figure 7:
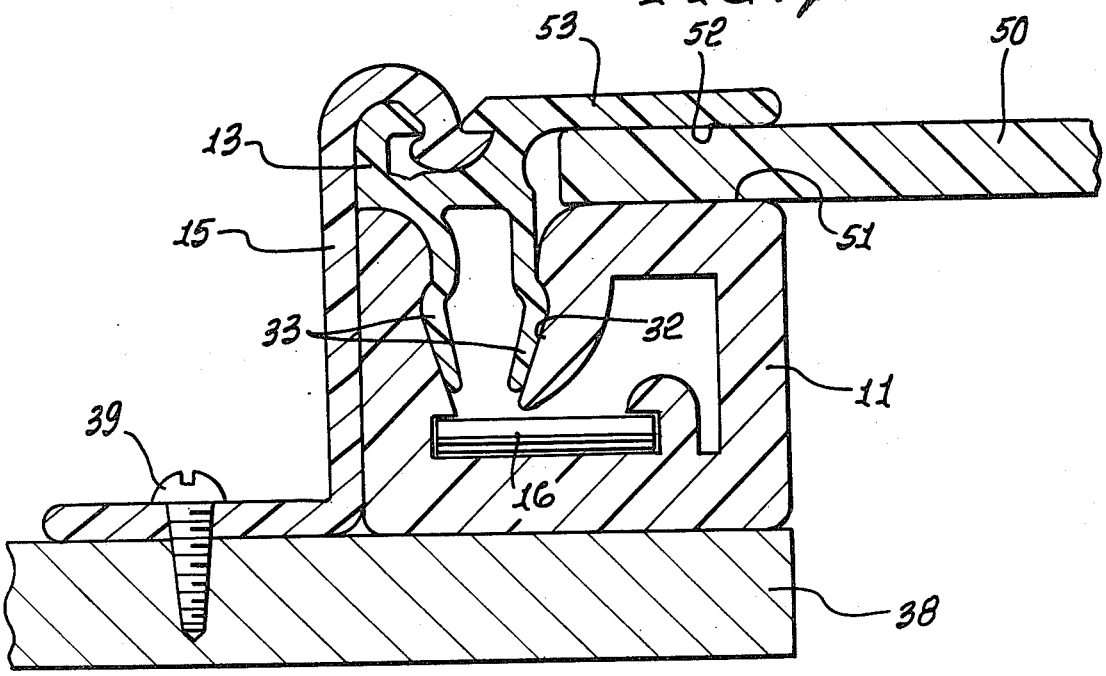
FIG. 7 is a view similar to that of FIG. 2 showing an alternative embodiment of the invention which uses rigid glazing such as acrylic or glass.

An alternative embodiment of the invention suitable for use with rigid glazing, such as glass or acrylic or the like, is shown in FIG. 7, where elements corresponding to those of FIGS. 1–6 are identified by the same reference numerals.

In the embodiment of FIG. 7, a rigid glazing sheet 50 is positioned between the upper surface 51 of the frame member 11 and the lower surface 52 of an extension 53 of the lock strip 13. The fingers 33 of the lock strip 13 pop into the base section 32 of the frame member 11, in the same manner as with the embodiment of FIGS. 1–6. Hence the configuration of FIG. 7 can be utilized with either the rigid glazing 50 or with the flexible glazing 12, in the manner shown in FIG. 2.

I claim:

1. In a window or the like, the combination of:

a frame with frame members defining a glazing face, with first grooves in opposing frame members at said glazing face;

a glazing sheet over said frame members;

lock strips inserted in opposing first grooves, with said sheet disposed between the lock strips and frame members, said lock strips having second grooves parallel with said first grooves; and mounting clips each having a first end for attachment to a support surface and a second end inserted into a second groove.

2. A window as defined in claim 1 wherein said clip second ends and lock strip second grooves have interlocking surfaces, with one of said second end and groove being deformable for interlocking with the other.

3. A window as defined in claim 2 wherein said second groove has a wider base section and a narrower throat section, and said clip second end has an enlarged portion wider than said throat section for pushing into said base section.

4. A window as defined in claim 2 wherein said lock strips and frame member first grooves have interlocking surfaces, with one of said lock strip and frame member being flexible for interlocking with the other.

5. A window as defined in claim 1 wherein said frame includes four elongate frame members joined at the ends thereof by corner fasteners to form said frame, each of said frame members having an elongate slot parallel with the groove therein, each of said corner fasteners having arms at right angles to each other and of a size to enter a frame member slot.

6. A window as defined in claim 5 with at least one of said corner fasteners and frame members including means for maintaining said fasteners and frame members together.

7. A window as defined in claim 5 with said corner fastener arms being curved to be a push fit into said frame member slots.

8. A window as defined in claim 5 with said frame member having protrusions into said slots providing an interference fit with said corner fastener arms.

9. A window as defined in claim 1 wherein said glazing sheet is flexible and is clamped in said first grooves by said lock strips.

10. A window as defined in claim 1 wherein said glazing sheet is rigid and is clamped on said frame members by said lock strips.

11. In a window or the like, the combination of:

a removable frame with frame members joined together defining a glazing face, with first grooves in opposing frame members at said glazing face;

a glazing sheet over said frame members, and lock strips inserted in opposing first grooves, with said sheet disposed between the lock strips and frame members.

12. A window as defined in claim 11 wherein said glazing sheet is flexible and is clamped in said first grooves by said lock strips.

13. A window as defined in claim 11 wherein said glazing sheet is rigid and is clamped on said frame members by said lock strips.

14. In a window or the like, the combination of:

a removable frame with frame members joined together defining a glazing face, with first grooves in opposing frame members at said glazing face;

a glazing sheet over said frame members;

lock strips inserted in opposing first grooves, with said sheet disposed between the lock strips and frame members, said lock strips having second grooves parallel with said first grooves;

with said first grooves having a wider base section and a narrower throat section between said base section and glazing face, and with said lock strips having spaced flexible fingers with an overall width greater than said narrower throat section for pushing into said wider base section, and with said second grooves having a wider base section and a narrower throat section, and said clip second ends having an enlarged portion wider than said throat section for pushing into said base section.

* * * * *